United States Patent [19]

Wells

[11] Patent Number: 4,527,437

[45] Date of Patent: Jul. 9, 1985

[54] PIPETTE CONTROLLER

[75] Inventor: John R. Wells, Culver City, Calif.

[73] Assignee: Wescor, Inc., Logan, Utah

[21] Appl. No.: 672,159

[22] Filed: Nov. 16, 1984

Related U.S. Application Data

[63] Continuation-in-part of Ser. No. 511,212, Jul. 6, 1983, abandoned.

[51] Int. Cl.[3] ..... B01L 3/02

[52] U.S. Cl. ..... 73/864.11; 73/864.16

[58] Field of Search ..... 73/864.11, 864.12, 864.13, 73/864.14, 864.15, 864.16, 864.17, 864.18; 422/100

[56] References Cited

U.S. PATENT DOCUMENTS

| | | | |
|---|---|---|---|
| 2,164,711 | 7/1939 | Kadavy | 73/864.16 |
| 2,866,340 | 12/1958 | Goldberg | 73/864.11 |
| 3,786,683 | 1/1974 | Berman et al. | 73/864.14 |
| 3,963,061 | 6/1976 | Kenney | 73/864.14 |
| 4,296,071 | 10/1981 | Weiss | 73/864.11 |

FOREIGN PATENT DOCUMENTS

| | | | |
|---|---|---|---|
| 1276369 | 8/1968 | Fed. Rep. of Germany | 73/864.16 |

*Primary Examiner*—S. Clement Swisher
*Attorney, Agent, or Firm*—Donald G. Lewis

[57] ABSTRACT

The invention is a pipette controller for facilitating the handling of liquids by a pipette. The pipette attaches to the pipette controller. The pipette controller has a handle which is proximate to the attached pipette and substantially parallel to the pipette. The user operates the pipette controller by working a thumb wheel on the handle which is mechanically coupled to a bellows which controls the liquid level in the attached pipette. When operating the pipette controller, the user grasps the hand below the thumb wheel at a position which is approximately medial to the length of a typical pipette.

17 Claims, 6 Drawing Figures

PIPETTE CONTROLLER

This is a continuation-in-part of co-pending application Ser. No. 511,212 filed on July 6, 1983 now abandoned.

BACKGROUND

The invention relates to the field of pipetting. More specifically, the invention relates to devices which connect to a pipette and provide means both for handling the pipette and for drawing up and dispensing liquid from the pipette. The pipettes used with these devices should be either graduated or volumetric to enable the user to read the volume. The invention facilitates pipetting.

Many devices which facilitate pipetting are known in the prior art. Devices which provide the means to draw up and dispense liquids from a pipette are useful because they eliminate many of the dangers inherent in mouth pipetting. However, many of the commonly used pipetting devices either lack a handle or have an inadequate handle to control the movement and orientation of the pipette. An example of a pipetting device which lacks an adequate handle is described in U.S. Pat. No. 3,039,500. It is difficult to both operate the device and control the orientation of the pipette tip for delivering or receiving liquids without an adequate handle.

A pipetting device which includes a handle is described in U.S. Pat. No. 3,244,009 (Tietje). However, the Tietje device teaches that the pipette should be attached to the neck of the device at an acute angle. This puts the tip of the pipette at a far distance from the user's grasp on the handle, frequently causing the user some difficulty in controlling the position of the tip of the pipette. The present pipette controller requires that the pipette attach to the neck of the device at substantially a right angle, imparting an inverted "U" shape to the assembly. In the present pipette controller, the handle is substantially parallel to the attached pipette and the user's grasp on the handle is approximately medial to the length of the parallel pipette. The inverted "U" shape provides the user with greater control over the motion and positioning of the pipette tip for delivering liquid; also the inverted "U" shape facilitates the user's simultaneous visual monitoring of the operation of the device, the monitoring of the liquid level in the pipette, and the location of the pipette tip. The inverted "U" shape allows the user to accurately control the volume of liquid drawn up or dispensed by working the liquid control mechanisms of the pipette controller while simultaneously monitoring the relation between the liquid level and the graduations or volumetric markings of the pipette.

SUMMARY

The pipette controller is a device which facilitates the volumetric accuracy of pipetting of liquids, which facilitates the user's control over the positioning of the pipette tip for receiving and delivering liquids, and which conforms to the typical human anatomy in order to provide the user with comfort during the motions of repetitious pipetting.

The volumetric precision results from the sensitivity of a mechanical system which is coupled to a bellows which in turn communicates with the pipette and controls the liquid level therein. The user operates a thumb wheel which drives the mechanical system which is coupled to the bellows. The sensitivity of the mechanical system may be selected to fit the user's needs. The user selects a pipette controller with a sensitivity which will render the desired accuracy for the particular volume of liquid to be pipetted.

The volumetric precision also results from the position of the attached pipette relative to the handle and the thumb wheel of the pipette controller. This positioning of the user's handgrip improves the volumetric precision due to human factors. The conformation of the pipette controller places the liquid level in the pipette and the thumb wheel in relative proximity. This facilitates the user's simultaneous visual monitoring of both the liquid level and the action of the thumb wheel. This simultaneous monitoring facilitates the user's coordination between the thumb wheel and the liquid level in the pipette.

The user's control over the positioning of the pipette tip for receiving and delivering liquids is also facilitated by the orientation of the user's handgrip and the thumb wheel with respect to the attached pipette. The user's handgrip on the pipette controller is substantially parallel to the pipette and approximately medial to the length of the pipette. The user's hand motions for positioning the pipette tip are approximately the same for a hand held pipette and a pipette attached to a pipette controller. This can give the user an quick sense of familiarity. Also, since the user's fingers and palm are sufficient to hold and control the pipette controller, the thumb is left free to operate the thumb wheel. Control is also facilitated by the user's ability to visually monitor the location of the pipette tip, the fluid level in the pipette, and thumb wheel all simultaneously.

The pipette controller conforms to the typical human anatomy in order to provide the user with comfort during the motions of repetitious pipetting. The inverted "L" shape of the device brings the pipette into proximity with the handle and the user's manipulating hand, enabling the user's elbow to rest on a surface. This is particularly important during repetitive pipetting because it renders comfort, leverage, and stability.

DESCRIPTION

Figure 1:
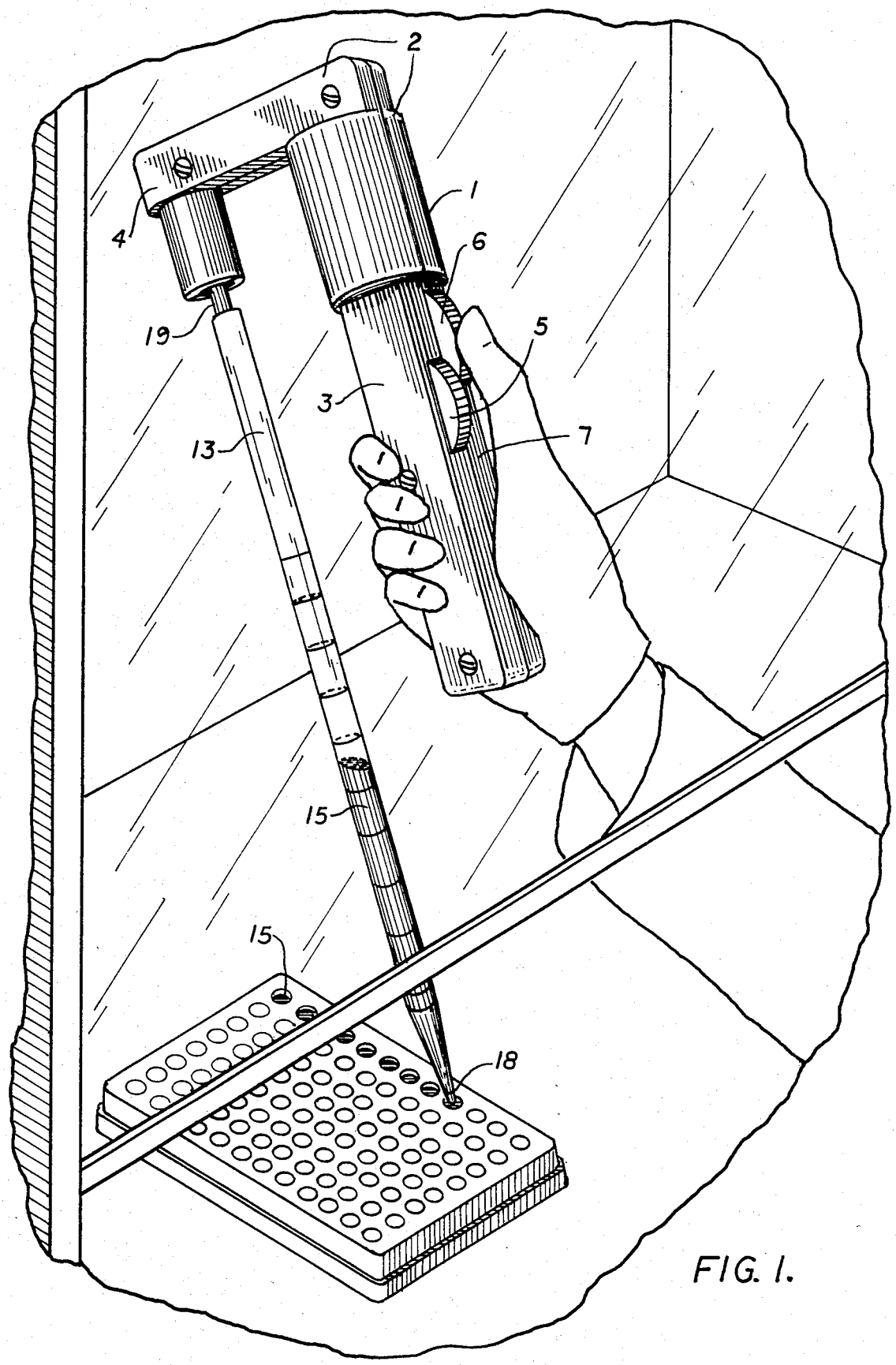
FIG. 1 is a perspective view of the pipette controller and a pipette in use behind the safety window of a ventilation hood illustrating the placement of the user's handgrip and thumb and illustrating the delivery of liquid from the pipette.
Figure 2:
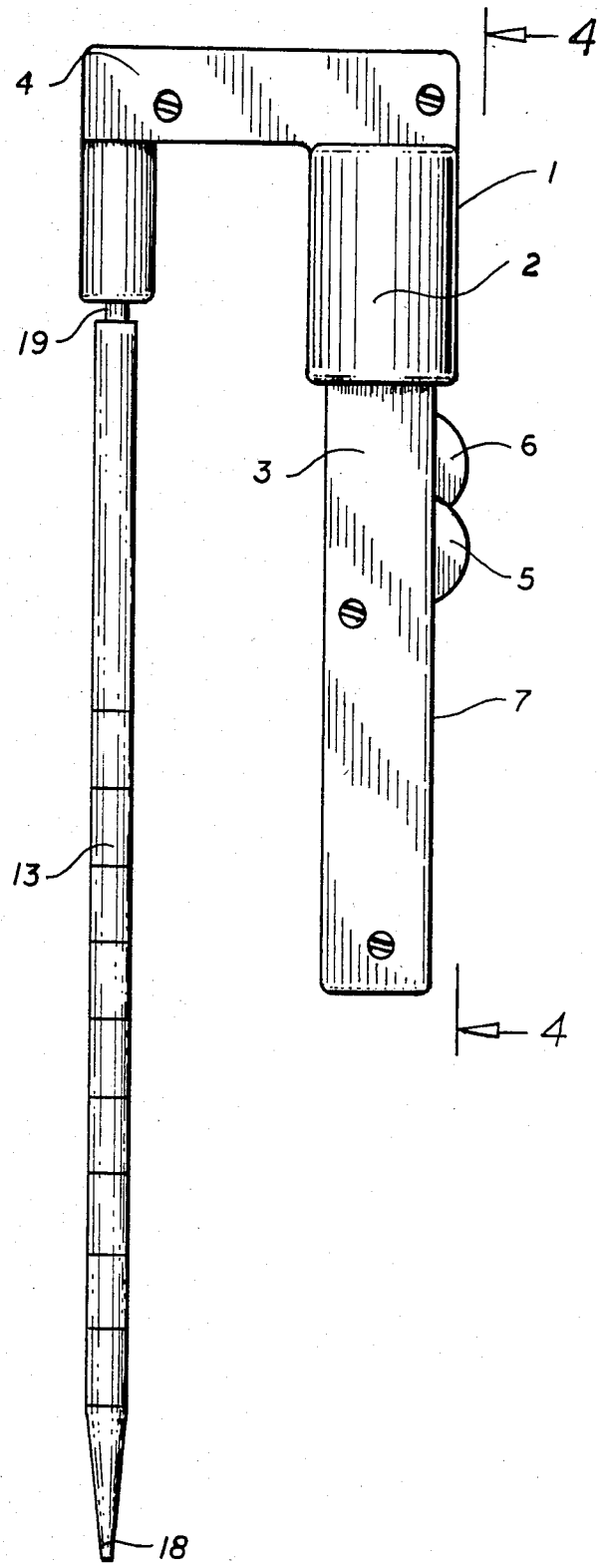
FIG. 2 is an orthogonal view of the pipette controller and a pipette of FIG. 1. illustrating the inverted "L" shape of the casing with a handle portion and a neck portion and illustrating the thumb wheel exposed on backside of the handle.

The pipette controller (1) has a casing (2) with an inverted "L" conformation. The casing (2) includes a handle (3) and a neck (4). Inside and attached to the handle (3) is at least one thumb wheel (5&6) adapted for rotational action, e.g. a first thumb wheel (5) and a second thumb wheel (6). The thumb wheel (5&6) is exposed to the outside of the casing (2) on the back side (7) of the handle (3), i.e. on the side opposite the direction of the neck (4). Engaged to the thumb wheel (5&6) is a mechanical train (8,9,&10). The mechanical train (8,9,&10) converts the rotational action of the thumb wheel (5&6) to translational action. The mechanical train (8,9,&10) may snubbed to prevent unintended frictionless motion. One possible version of the mechanical train is a rack (8) and pinion (9&10) combination. The pinion (9&10) is coaxially connected to the thumb wheel (5&6). The rack (8) is engaged to the pinion (9&10). The rotational action of the thumb wheel (5&6) and the coaxially connected pinion (9&10) drive the engaged rack (8) to produce translational action. In order to give the user a selection of thumb wheels (5&6) with different drive ratios, a first thumb wheel (5) may be coaxially connected to a first pinion (9) with many gear teeth and a second thumb wheel (6) may be coaxially connected to a second pinion (10) with fewer gear teeth. Both pinions (9&10) are engaged to the rack (8), but a rotation of the first thumb wheel (5) results in greater translational movement of the rack (8) and lesser sensitivity of control than an equivalent rotation of the second thumb wheel (6). The rack (8), in turn, is engaged to a bellows (11, 20 & 21). The bellows (11, 20 & 21) is also attached to the casing (2), so that the bellows (11, 20 & 21) expands and collapses with the translational action of the engaged rack (8). The bellows (11, 20 & 21) is linked to a pipette connector (12). When a pipette (13) is attached to the pipette controller (1), it is inserted into the pipette connector (12). An optional air tube (14) may be inserted between the bellows (11, 20 & 21) and the pipette connector (12) merely to accomodate a change in the location of the bellows (11, 20 & 21) within the casing (2) or a change in the length of the neck (4) of the casing (2). The air tube (14) guides air between the bellows (11, 20 & 21) and the pipette connector (12). Alternatively, the bellows (11, 20 & 21) may be directly linked to the pipette connector (12), thereby eliminating the air tube (14).

Figure 3:
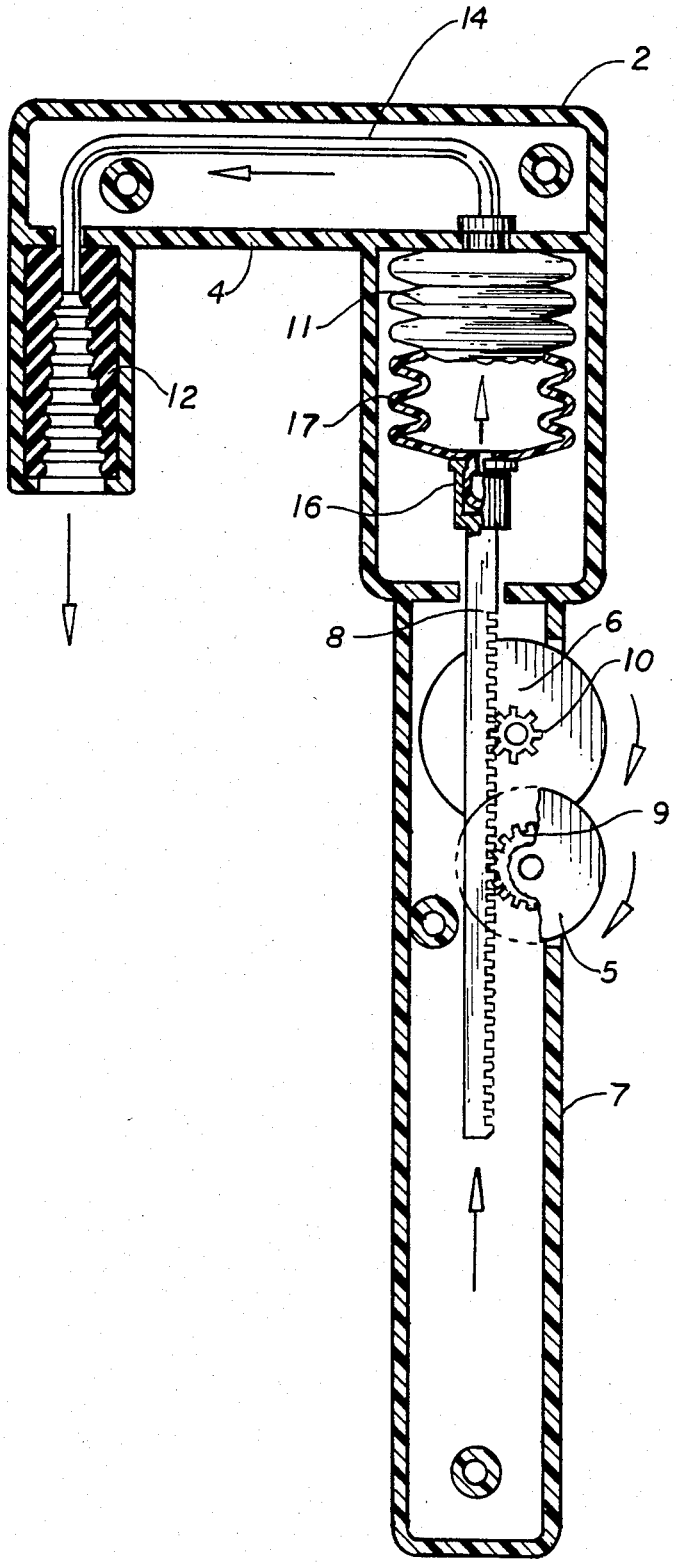
FIG. 3 is a sectional view of the pipette controller of FIG. 4 illustrating the thumb wheels, the pinions, the rack, the accordion type bellows, the air tube, and the pipette connector, all in the interior of the casing.
Figure 4:
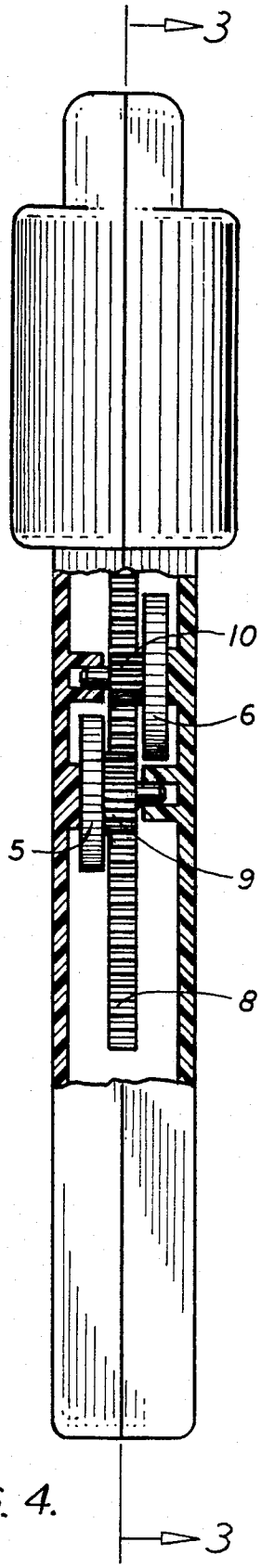
FIG. 4 is partially a sectional view and partially an orthogonal view of the pipette controller of FIG. 2, the sectional view illustrating the thumb wheel, the pinions, and the rack, the orthogonal view illustrating the handle.
Figure 5:
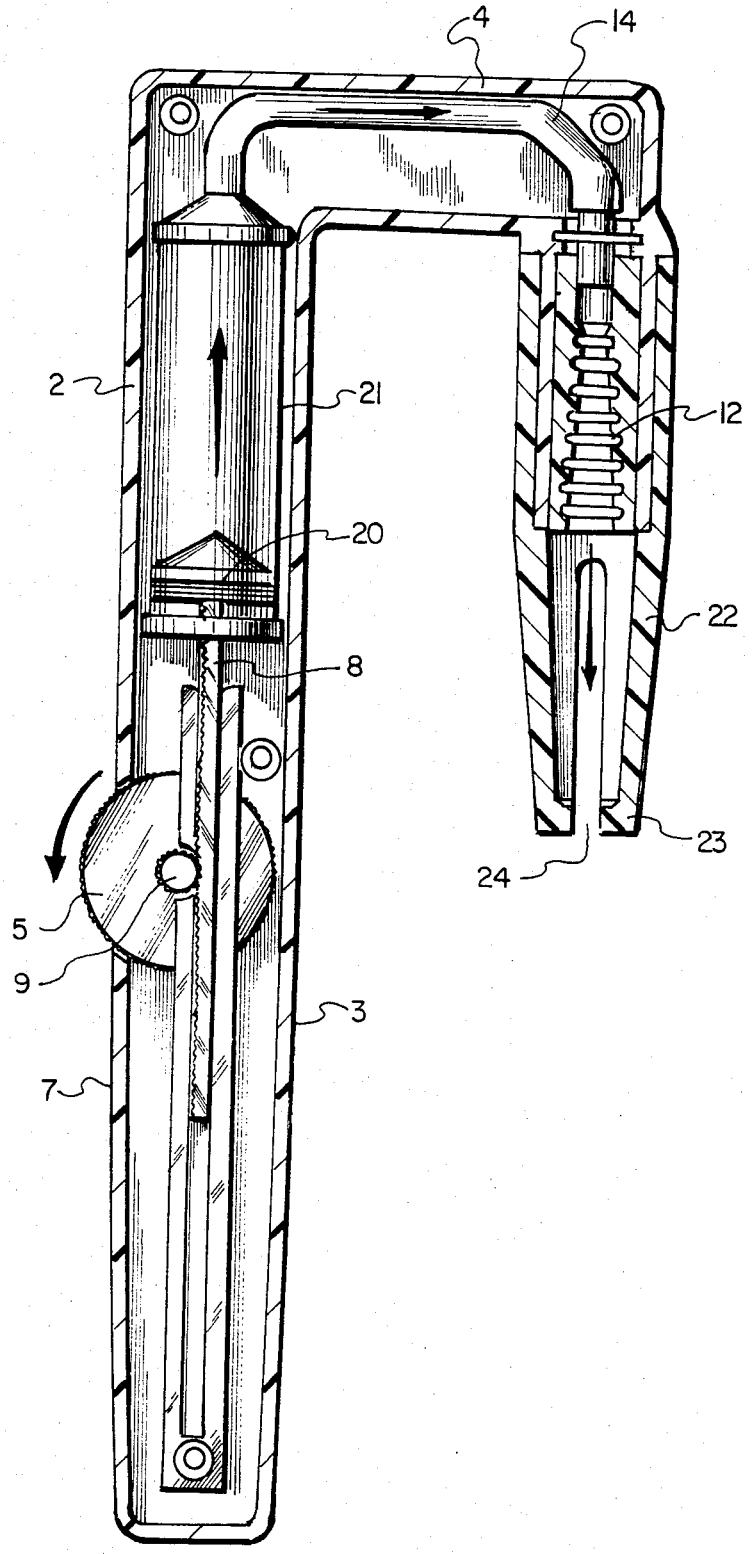
FIG. 5 is a sectional view of the pipette controller of FIG. 6 illustrating the casing, the thumb wheel, the pinion, the rack, the piston/cylinder type bellows, the air tube, the pipette connector, and the pipette brace.
Figure 6:
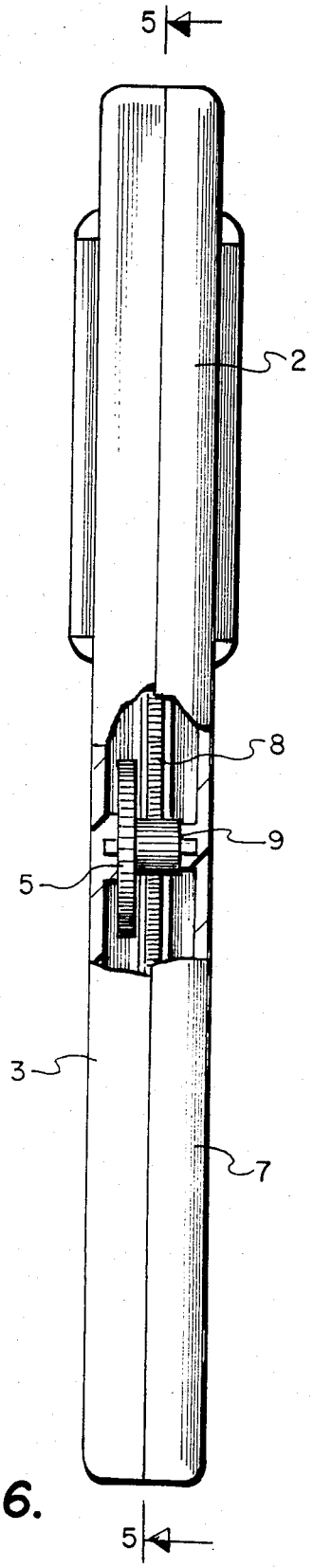
FIG. 6 is partially a sectional view and partially an orthogonal view of the pipette controller of FIG. 5, the sectional view illustrating the thumb wheel, the pinion, and the rack, the orthogonal view illustrating the handle.

The casing (2) may be constructed as two halves for ease in replacing the bellows (11, 20 & 21), the air tube (14), or the pipette connector (12). FIG. 3 illustrates the pipette controller (1) with one half of the casing (2) removed and exposing the interal components. Replacement of the bellows (11, 20 & 21), the air tube (14), or the pipette connector (12) may be necessitated if they are contaminated by liquid (15) from the pipette (13). Normally these components are kept dry. The bellows (11, 20 & 21), air tube (14), and pipette connector (12) may be manufactured as disposables and readily detachable from one an other to facilitate their replacement in the pipette controller (1) in the event of contamination or ordinary wear.

The bellows (11) may be an elastic accordian shaped bellows (11, 20 & 21), an elastic bulb, or a piston and cylinder system. The preferred embodiment of the invention may include either an accordian type bellows (11) or a piston/cylinder type bellows (20 & 21). In either case, the bellows (11, 20 & 21) is engaged to the rack (8). The bellows (11, 20 & 21) may be attached to the rack (8) by a fastener (16) to provide optimum control in returning the bellows (11, 20 & 21) to its fully expanded position. However, if the device includes means for urging the bellows (11, 20 & 21) to its expanded position, as with the elastic folds of the accordion type bellows (17), the rack (8) need merely abut the bellows (11, 20 & 21) and a fastener (16) is not required.

The casing (2) of the device has an inverted "L" shape, so that when the pipette (13) is inserted into the pipette connector (12), the pipette (13) is to proximate to and substantially parallel to the handle (3). The inverted "L" shaped device together with the attached pipette (13) forms an inverted "U" shape. The user's hand grasps the handle (3) below the thumb wheel (5&6) and approximately medial to the length of the attached pipette (13). A firm grasp on the handle (3) may be maintained by the user's fingers and palm while the user's thumb is free to operate the thumb wheel (5&6). When the user grasps the handle (3) and engages the thumb wheel (5&6), the user's handgrip is in a thumb up position with the thumb pointing toward the neck (4) and resting tangentially on the thumb wheel (5&6). The orientation of the user's handgrip and thumb facilitates the user's hand-eye coordination, allowing the user to rest his elbow while pipette and while simultaneously monitoring the liquid (15) level in the pipette (13) and the action of the thumb wheel (5&6) in the same glance of the eye. The tip of the attached pipette (18) is at a height approximately midwau between the user's hand and his elbow, so that when the elbow is resting on the same surface as a vessel containing liquid (15), the pipette tip (18) will be near the opening of average sized laboratory vessels. This configuration tends to alleviate the fatigue of repetitious pipetting.

The pipette connector (12) links the attached pipette to the bellows (11, 20 & 21) via the air tube (14). When the mouth end of the pipette (19) is inserted into the pipette connector (12), the pipette connector (12) forms a seal to prevent the leakage of outside air into the system and the subsequent leakage of liquid (15) from the tip of a loaded pipette (18).

The pipette connector (12) also serves to position and stabilize the pipette (13). The pipette connector (12) may be fixed to the neck (4) of the casing (2) so as to hold the attached pipette (13) in a position which is substantially parallel and proximate to the handle (3). Alternatively, the pipette connector (12) may be attached to the neck (4) of the casing (2) by a swivel fitting, enabling the user to change the angle between the pipette (13) and the handle (3). The swivel fitting allows the user to select a variety of positions for the pipette (13).

The device may be used with or without a stabilizer clip, or brace (22) depending on how steady the user wishes the pipette (13) to be held. The clip extends from the casing (2) to the pipette (13). The clip attaches to the front side of the handle (3). The brace (22) is attached to the casing (2) and extends past the pipette connector (12). The brace (22) includes resilient arms (23) and slots (24) which define an expandable opening which is smaller than the width of the typical pipette (13) to be used. When a pipette (13) is inserted into the opening of the brace (22) and into the pipette connector (12), the arms of the brace (23) expand outward and the resiliency of the arms (23) then hold the pipette (13) tighly in place by means of their spring action. The clip and the brace (22) remain functional even when the angle of the pipette (13) is altered by the use of a swivel fitting for the pipette connector (12).

The instant specification and claims set forth here are meant to be illustrative and not restrictive. All functional equivalencies, modifications and changes which may be made without departing from the spirit and scope of the present invention are intended to be embraced herein.

What is claimed is:

1. A pipette controller for facilitating a user's control of a pipette while pipetting liquids comprising:

a casing having an inverted "L" shape forming a handle and a neck, at least one thumb wheel attached to the handle and adapted for rotational action, a mechanical train engaged to the thumb wheel for converting the rotational action of the thumb wheel to translational action, a bellows attached to the casing and engaged to the mechanical train, expandable and collapsible by the translational action of the mechanical train, an air tube attached to the bellows for guiding air to and from the bellows, a pipette connector attached both to the neck and to the the air tube, for connecting the pipette to the pipette controller, for positioning the pipette proximate to and substantially parallel to the handle, and for communicating air between the air tube and the pipette, whereby the user operates the thumb wheel of the pipette controller to control liquids within the pipette connected to the pipette controller while the pipette is held proximate to and substantially parallel to the handle of the pipette controller in easy view of the user.

2. The invention of claim 1 wherein the handle of the casing has a back side which is opposite the direction of the neck and wherein the attachment of the thumb wheel to the handle exposes the thumb wheel on the back side of the handle for operation by the user.

3. The invention of claim 1 wherein the thumb wheel includes a coaxial pinion and the mechanical train includes a rack engaged to the coaxial pinion and attached to the bellows.

4. The invention of claim 3 wherein the thumb wheel includes a first thumb wheel with a large coaxial pinion and a second thumb wheel with a small coaxial pinion, the large thumb wheel and the small thumb wheel each engaged to the rack.

5. The invention of claim 1 wherein the engagement between the bellows and the mechanical train includes means for fastening the bellows to the mechanical train.

6. The invention of claim 1 further comprising means for urging the bellows to expand, the urging means connected to both the bellows and to the casing and wherein the engagement between the bellows and the mechanical train includes mere abutment.

7. The invention of claim 1 further comprising a snub connected to the casing and acting upon the mechanical train for preventing frictionless action.

8. The invention of claim 1 wherein the pipette connector is disposable and detachable from the neck and from the air tube.

9. The invention of claim 1 wherein the air tube is disposable and detachable from the pipette connector and from the bellows.

10. The invention of claim 1 wherein the bellows is disposable and detachable from the handle and from the mechanical train.

11. The invention of claim 1 further including a stabilizer clip attachable both to the handle and to the pipette for steadying the tip of the pipette during use.

12. The invention of claim 1 wherein the neck includes a swivel fitting for positioning the pipette connector within a range of angular rotation, thereby enabling the pipette connector to position the connected pipette into a corresponding range of positions which includes positions in addition to the position which is proximate and substantially parallel to the handle.

13. A pipette controller for facilitating a user's control of a pipette while pipetting liquids to be used with a bellows, an air tube, and a pipette connector; the bellows connected to the air tube, the air tube connected to the pipette connector, and the pipette connector connected to the pipette; the air tube for guiding air between the bellows and the pipette connector, the pipette connector for guiding air between the air tube and the pipette and for positioning the pipette; the pipette controller comprising:

a casing having an inverted "L" shape forming a handle and a neck, the handle adapted to receive and connect to the bellows, the neck adapted to receive and connect to the pipette connector and enabling the pipette connector to position the pipette proximate to and substantially parallel to the handle, a thumb wheel attached to the handle and adapted for rotational action, and a mechanical train engaged to the thumb wheel for converting the rotational action of the thumb wheel to translational action, the mechanical train adapted to engage the bellows for expanding and collapsing the bellows by the translational action, whereby the user operates the thumb wheel of the pipette controller to control liquids within the pipette while the pipette is held proximate to and substantially parallel to the handle of the pipette controller in easy view of the user.

14. A pipette controller for facilitating a user's control of a pipette while pipetting liquids to be used with a bellows and a pipette connector; the bellows connected to the pipette connector, and the pipette connector connected to the pipette; the pipette connector for guiding air between the bellows and the pipette and for positioning the pipette; the pipette controller comprising:

a casing having an inverted "L" shape forming a handle and a neck, the handle adapted to receive and connect to the bellows, the neck adapted to receive and connect to the pipette connector and enabling the pipette connector to position the pipette proximate to and substantially parallel to the handle, a thumb wheel attached to the handle and adapted for rotational action, and a mechanical train engaged to the thumb wheel for converting the rotational action of the thumb wheel to translational action, the mechanical train adapted to engage the bellows for expanding and collapsing the bellows by the translational action, whereby the user operates the thumb wheel of the pipette controller to control liquids within the pipette while the pipette is held proximate to and substantially parallel to the handle of the pipette controller in easy view of the user.

15. The invention of claim 1 wherein the bellows is an accordion type bellows.

16. The invention of claim 1 wherein the bellows is a piston/cylinder type bellows.

17. The invention of claim 1 further including a brace connected to the casing and extending beyond the pipette connector for steadying the tip of the pipette during use.

* * * * *